US009482228B2

(12) United States Patent
Fujita et al.

(10) Patent No.: US 9,482,228 B2
(45) Date of Patent: Nov. 1, 2016

(54) VARIABLE CAPACITY VANE PUMP WITH A ROTOR AND A CAM RING ROTATABLE ECCENTRICALLY RELATIVE TO A CENTER OF THE ROTOR

(71) Applicant: KAYABA INDUSTRY CO., LTD., Minato-ku, Tokyo (JP)

(72) Inventors: Tomoyuki Fujita, Kani (JP); Masamichi Sugihara, Kani (JP); Koichiro Akatsuka, Gifu (JP); Fumiyasu Kato, Kasugai (JP)

(73) Assignee: KYB Corporation, Tokyo (JP)

( * ) Notice: Subject to any disclaimer, the term of this patent is extended or adjusted under 35 U.S.C. 154(b) by 15 days.

(21) Appl. No.: 14/386,328

(22) PCT Filed: Mar. 1, 2013

(86) PCT No.: PCT/JP2013/055695
§ 371 (c)(1),
(2) Date: Sep. 18, 2014

(87) PCT Pub. No.: WO2013/141001
PCT Pub. Date: Sep. 26, 2013

(65) Prior Publication Data

US 2015/0030486 A1 Jan. 29, 2015

(30) Foreign Application Priority Data

Mar. 19, 2012 (JP) ..... 2012-062309

(51) Int. Cl.
*F03C 4/00* (2006.01)
*F04C 2/00* (2006.01)
*F04C 14/18* (2006.01)
(Continued)

(52) U.S. Cl.
CPC ..... *F04C 14/223* (2013.01); *F04C 2/344* (2013.01); *F04C 14/226* (2013.01); *F04C 15/06* (2013.01); *F04C 15/062* (2013.01); *F04C 18/344* (2013.01); *F04C 14/08* (2013.01);
(Continued)

(58) Field of Classification Search
CPC .... F04C 14/223; F04C 14/226; F04C 14/10; F04C 14/08; F04C 2/344; F04C 18/344; F04C 15/06; F04C 2250/10; F04C 2250/101
USPC ..... 418/24–28, 30, 259, 266–268
See application file for complete search history.

(56) References Cited

U.S. PATENT DOCUMENTS 7,798,790 B2 * 9/2010 Lutoslawski ..... F04C 14/226 418/26
2002/0114708 A1 8/2002 Hunter et al.

FOREIGN PATENT DOCUMENTS

JP 2010265852 A 11/2010
JP 2011140918 A 7/2011

OTHER PUBLICATIONS

International Search Report and Written Opinion mailed May 21, 2013, corresponding to International patent application No. PCT/JP2013/055695.

*Primary Examiner* — Theresa Trieu
(74) *Attorney, Agent, or Firm* — Hauptman Ham, LLP

(57) ABSTRACT

In a variable capacity vane pump in which a discharge capacity of a pump chamber is varied by varying an amount of eccentricity of a cam ring relative to a rotor, a port inner wall surface that extends around an inner peripheral cam surface of the cam ring when the cam ring moves in a direction for increasing the amount of eccentricity of the cam ring relative to the rotor is formed on an intake port.

7 Claims, 5 Drawing Sheets

(51) Int. Cl.

| | |
|---|---|
| ***F04C 14/22*** | (2006.01) |
| ***F04C 15/06*** | (2006.01) |
| ***F04C 18/344*** | (2006.01) |
| ***F04C 2/344*** | (2006.01) |
| *F04C 14/10* | (2006.01) |
| *F04C 14/08* | (2006.01) |

(52) U.S. Cl.

CPC ..... *F04C 14/10* (2013.01); *F04C 2250/10* (2013.01); *F04C 2250/101* (2013.01)

VARIABLE CAPACITY VANE PUMP WITH A ROTOR AND A CAM RING ROTATABLE ECCENTRICALLY RELATIVE TO A CENTER OF THE ROTOR

TECHNICAL FIELD

The present invention relates to a variable capacity vane pump used as a fluid pressure supply source in a fluid pressure device.

BACKGROUND ART

In an example of this type of variable capacity vane pump, a cam ring swings using a pin as a fulcrum such that an amount of eccentricity of the cam ring relative to a rotor is varied, and as a result, a discharge capacity varies.

JP2011-140918A discloses a variable capacity vane pump in which a discharge port of the vane pump is formed so as not to interfere with a cam ring so that an opening area of the discharge port does not vary even when the cam ring moves.

SUMMARY OF INVENTION

In this type of variable capacity vane pump, as the cam ring moves, the cam ring forms a step that blocks a part of an intake port. Therefore, a working fluid suctioned into a pump chamber may impinge on the step, leading to an increase in pressure loss exerted on the working fluid, and as a result, cavitation may occur between the intake port and the pump chamber.

The present invention has been designed in consideration of this problem, and an object thereof is to prevent cavitation caused by a cam ring of a variable capacity vane pump.

According to one aspect of the present invention, a variable capacity vane pump used as a fluid pressure supply source includes: a rotor that is driven to rotate; a plurality of vanes housed in the rotor to be free to slide; a cam ring that includes an inner peripheral cam surface against which respective tip end portions of the vanes slide, and is capable of rotating eccentrically relative to a center of the rotor; a pump chamber defined between the rotor, the cam ring, and adjacent vanes; an intake port through which working fluid suctioned into the pump chamber is led; and a discharge port through which working fluid discharged from the pump chamber is led, wherein a port inner wall surface that extends around the inner peripheral cam surface of the cam ring when the cam ring moves in a direction for increasing an amount of eccentricity of the cam ring relative to the rotor is formed on the intake port.

Embodiments and advantages of the present invention will be described in detail below with reference to the attached drawings.

DESCRIPTION OF EMBODIMENTS

Figure 1A:
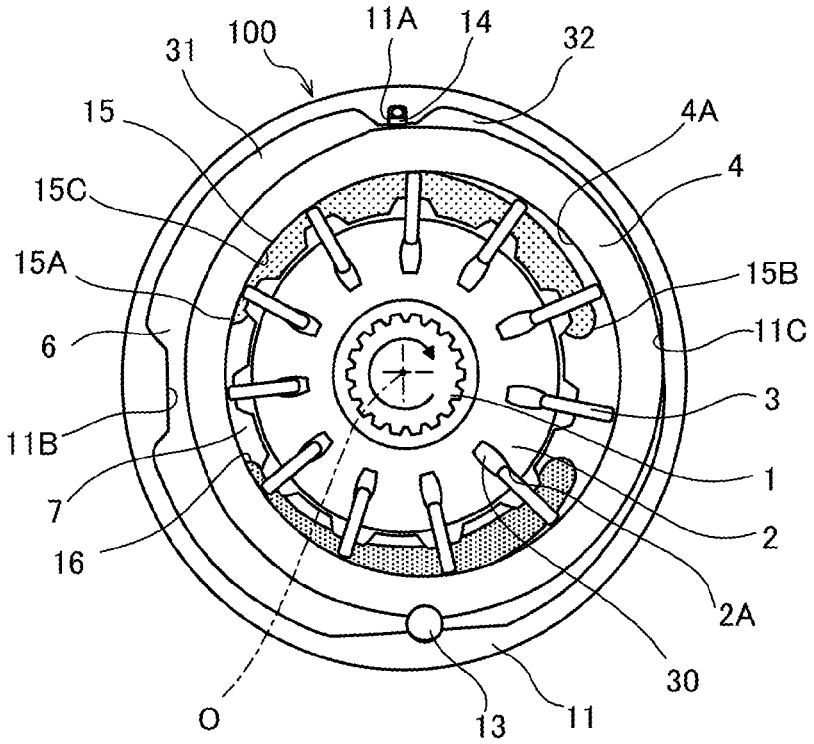
FIG. 1A is a front view showing a condition in which a cam ring of a variable capacity vane pump according to an embodiment of the present invention is in a maximum eccentricity position.

An embodiment of the present invention will be described below on the basis of the attached figures.

First, referring to FIGS. 1A and 1B, a variable capacity vane pump 100 according to this embodiment of the present invention will be described.

The variable capacity vane pump (referred to hereafter simply as the "vane pump") 100 is used as an oil pressure (fluid pressure) supply source for a hydraulic device (a fluid pressure device) installed in a vehicle, such as a power steering apparatus or a continuously variable transmission, for example.

The vane pump 100 is configured such that power from an engine (not shown) is transmitted to a drive shaft 1, whereby a rotor 2 coupled to the drive shaft 1 rotates. In FIGS. 1A and 1B, the rotor 2 rotates clockwise, as shown by arrows.

The vane pump 100 includes a plurality of vanes 3 provided to be capable of reciprocating in a radial direction relative to the rotor 2, and a cam ring 4 housing the rotor 2 and the vanes 3.

Slits 2A, each having an opening portion in an outer peripheral surface thereof, are formed in the rotor 2 radially at predetermined intervals. The vanes 3 are inserted into the slits 2A to be free to slide. A vane back pressure chamber 30 into which a pump discharge pressure is led is defined on a base end side of each slit 2A. The vanes 3 are pushed in a projecting direction from the slits 2A by the pressure in the vane back pressure chambers 30.

The drive shaft 1 is supported by a pump body 8 (see FIG. 3A) to be free to rotate. A pump housing recessed portion is formed in the pump body 8 to house the cam ring 4. A side plate 6 that contacts respective first side portions of the rotor 2 and the cam ring 4 is disposed on a bottom surface of the pump housing recessed portion. An opening portion of the pump housing recessed portion is sealed by a pump cover (not shown) that contacts respective second side portions of the rotor 2 and the cam ring 4. The pump cover and the side plate 6 are disposed so as to sandwich the respective side faces of the rotor 2 and the cam ring 4. A pump chamber 7 partitioned by the respective vanes 3 is defined between the rotor 2 and the cam ring 4.

Figure 2:
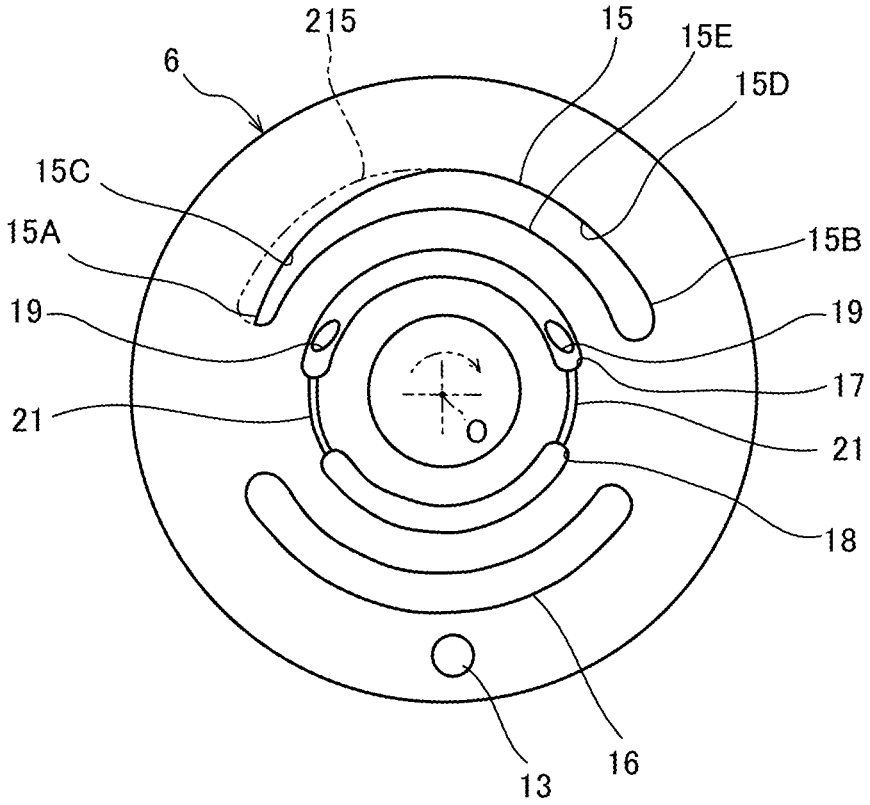
FIG. 2 is a front view of a side plate.

As shown in FIG. 2, an intake port 15 that leads working oil into the pump chamber 7 and a discharge port 16 that extracts the working oil in the pump chamber 7 and leads the extracted working oil to the hydraulic device are formed in the side plate 6. Specific shapes of the intake port 15 and the discharge port 16 will be described in detail below.

An intake port and a discharge port are also formed in the pump cover, not shown in the figures. The intake port and the discharge port of the pump cover communicate respectively with the intake port 15 and the discharge port 16 of the side plate 6 via the pump chamber 7.

Figure 1B:
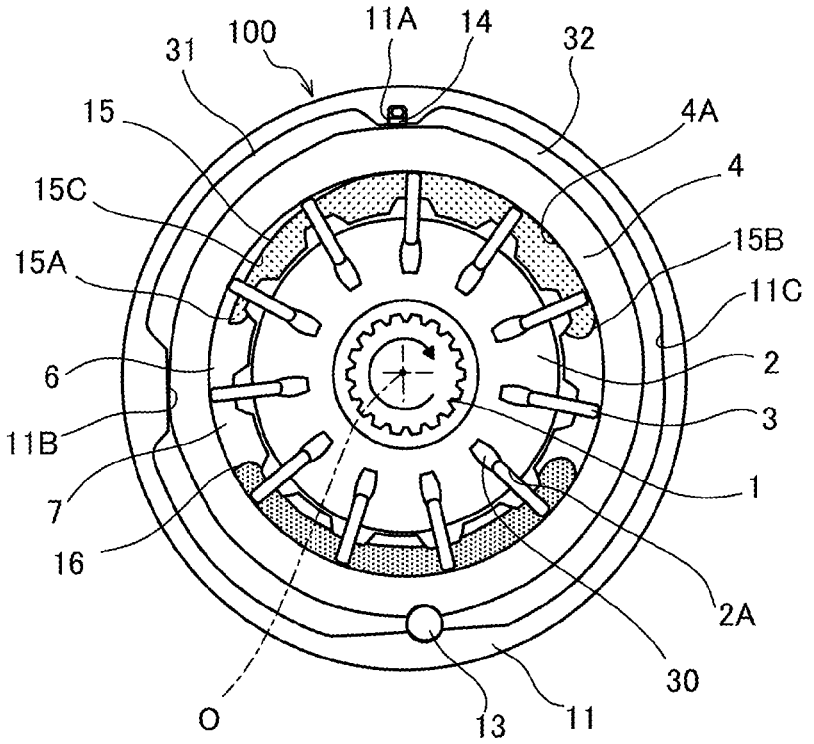
FIG. 1B is a front view showing a condition in which the cam ring of the variable capacity vane pump is in a minimum eccentricity position.

The cam ring 4 shown in FIGS. 1A and 1B is an annular member having an inner peripheral cam surface 4A against which respective tip end portions of the vanes 3 slide. The inner peripheral cam surface 4A is divided into an intake section into which working oil is suctioned through the intake port 15 as the rotor 2 rotates, and a discharge section from which working oil is discharged through the discharge port 16.

The intake port 15 is formed in a semicircular shape in a circumferential direction of the drive shaft 1. The intake port 15 communicates with a tank (not shown) via an intake passage (not shown). Working oil in the tank is supplied to the pump chamber 7 from the intake port 15 through the intake passage.

The discharge port 16 is formed in a semicircular shape on an opposite side to the intake port 15. The discharge port 16 communicates with a high pressure chamber (not shown) that is formed in the pump body 8 so as to penetrate the side plate 6. The high pressure chamber communicates with the hydraulic device (not shown) on the exterior of the vane pump 100 via a discharge passage (not shown). Working oil discharged from the pump chamber 7 is supplied to the hydraulic device through the discharge port 16, the high pressure chamber, and the discharge passage.

As shown in FIG. 2, back pressure ports 17 and 18 are formed in the side plate 6 to communicate with the vane back pressure chambers 30. Grooves 21 that connect respective ends of the back pressure ports 17 and 18 to each other are formed in the side plate 6. The back pressure port 17 communicates with the high pressure chamber via a through hole 19 penetrating the side plate 6. Working oil pressure discharged from the pump chamber 7 is led into the vane back pressure chambers 30 through the discharge port 16, the high pressure chamber, the through hole 19, and the back pressure ports 17 and 18. The vanes 3 are pushed in the projecting direction from the rotor 2 toward the cam ring 4 by the working oil pressure in the vane back pressure chambers 30.

When the vane pump 100 is operative, the vanes 3 are biased in the projecting direction from the slits 2A by the working oil pressure in the vane back pressure chambers 30, which pushes the base end portions of the vanes 3, and a centrifugal force that acts as the rotor 2 rotates. As a result, the tip end portions of the vanes 3 slide against the inner peripheral cam surface 4A of the cam ring 4.

In the intake section of the cam ring 4, the vanes 3 sliding against the inner peripheral cam surface 4A project from the rotor 2 such that the pump chamber 7 expands, and as a result, working oil is suctioned into the pump chamber 7 from the intake port 15. In the discharge section of the cam ring 4, the vanes 3 sliding against the inner peripheral cam surface 4A are pushed in by the rotor 2 such that the pump chamber 7 contracts, and as a result, pressurized working oil in the pump chamber 7 is discharged through the discharge port 16.

A configuration for varying a discharge capacity (a displacement capacity) of the vane pump 100 will now be described.

The vane pump 100 includes an annular adapter ring 11 that surrounds the cam ring 4. A support pin 13 is interposed between the adapter ring 11 and the cam ring 4. The cam ring 4 is supported by the support pin 13. The cam ring 4 swings on an inner side of the adapter ring 11 eccentrically relative to a center O of the rotor 2 using the support pin 13 as a fulcrum.

A sealing material 14 against which an outer peripheral surface of the cam ring 4 slides while swinging is interposed in a groove 11A of the adapter ring 11. A first fluid pressure chamber 31 and a second fluid pressure chamber 32 are defined between the outer peripheral surface of the cam ring 4 and an inner peripheral surface of the adapter ring 11 by the support pin 13 and the sealing material 14.

The cam ring 4 is caused to swing about the support pin 13 by a differential pressure between the first fluid pressure chamber 31 and the second fluid pressure chamber 32. When the cam ring 4 swings, an amount of eccentricity of the cam ring 4 relative to the rotor 2 varies, leading to variation in the discharge capacity of the pump chamber 7. When the cam ring 4 swings in a leftward direction from a condition shown in FIG. 1A, the amount of eccentricity of the cam ring 4 relative to the rotor 2 decreases, leading to a reduction in the discharge capacity of the pump chamber 7. When the cam ring 4 swings in a rightward direction from the condition shown in FIG. 1B, on the other hand, the amount of eccentricity of the cam ring 4 relative to the rotor 2 increases, leading to an increase in the discharge capacity of the pump chamber 7.

A limitation portion 11B that limits movement of the cam ring 4 in the direction for reducing the amount of eccentricity relative to the rotor 2 and a limitation portion 11C that limits movement of the cam ring 4 in the direction for increasing the amount of eccentricity relative to the rotor 2 are formed as respective bulges on the inner peripheral surface of the adapter ring 11. The limitation portion 11B prescribes a minimum amount of eccentricity of the cam ring 4 relative to the rotor 2. The limitation portion 11C prescribes a maximum amount of eccentricity of the cam ring 4 relative to the rotor 2.

The vane pump 100 is further provided with a control valve (not shown) that controls the working oil pressure led into the first fluid pressure chamber 31 and the second fluid pressure chamber 32. An orifice is provided in the discharge passage (not shown) communicating with the discharge port 16. The control valve controls the working oil pressure led into the first fluid pressure chamber 31 and the second fluid pressure chamber 32 using a spool that moves in accordance with a front-rear differential pressure of the orifice. The control valve controls the working oil pressure in the first fluid pressure chamber 31 and the second fluid pressure chamber 32 such that the amount of eccentricity of the cam ring 4 relative to the rotor 2 decreases as a rotation speed of the rotor 2 increases.

Figure 5:
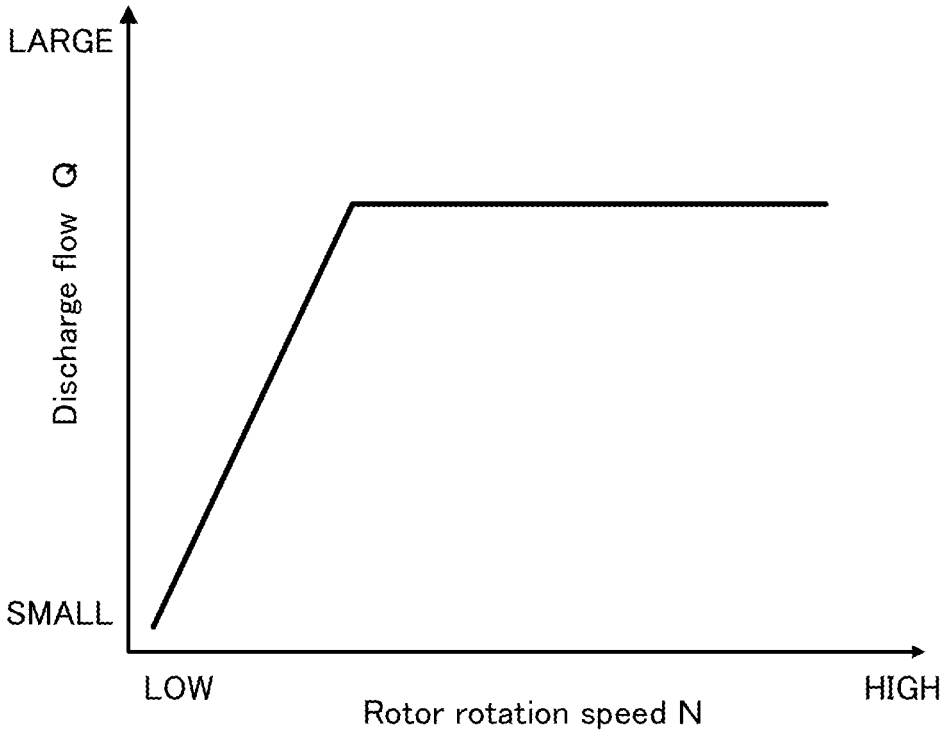
FIG. 5 is a characteristic diagram showing a relationship between a discharge flow and a rotation speed of a rotor of the variable capacity vane pump according to this embodiment of the present invention.

FIG. 5 is a characteristic diagram showing a relationship between a rotation speed N and a discharge flow Q of the rotor 2 of the vane pump 100. As shown on the characteristic diagram, in a low rotation speed region where the rotation speed N of the rotor 2 is lower than a predetermined value, the cam ring 4 is held in a maximum eccentricity position shown in FIG. 1A, whereupon the discharge flow Q increases gradually as the rotation speed N of the rotor 2 increases. In a medium/high speed region where the rotation speed N of the rotor 2 exceeds the predetermined value, the cam ring 4 gradually moves in a direction for reducing the amount of eccentricity as the rotation speed N of the rotor 2 increases, whereby a further increase in the discharge flow Q is suppressed. It should be noted that by employing the orifice as a variable throttle that operates in conjunction with displacement of the cam ring 4, the control valve can be set such that the discharge flow Q decreases gradually as the rotation speed N of the rotor 2 increases.

Next, referring to FIG. 2, the intake port 15 according to this embodiment of the present invention will be described.

The intake port 15 is formed to extend in an arc shape about the center O of the rotor 2. As shown in FIG. 1B, when a center of the cam ring 4 and the center O of the rotor 2 are substantially aligned, or in other words when the amount of eccentricity of the cam ring 4 is substantially zero, the intake port 15 extends in an arc shape around the inner peripheral cam surface 4A of the cam ring 4.

The intake port 15 includes a communication start side intake port end portion 15A at which communication with the pump chamber 7 starts as the rotor 2 rotates, and a communication end side intake port end portion 15B at which communication with the pump chamber 7 ends as the rotor 2 rotates. A port inner wall surface 15C is formed in the communication start side intake port end portion 15A, and an opening width of the intake port 15 is formed to decrease gradually from a midpoint of the intake port 15 toward a tip end of the communication start side intake port end portion 15A.

The port inner wall surface 15C is formed in the communication start side intake port end portion 15A so as to extend around the inner peripheral cam surface 4A of the cam ring 4 when the cam ring 4 moves (swings) in the direction for increasing the amount of eccentricity relative to the rotor 2, as shown in FIG. 1A. The port inner wall surface 15C is configured to deviate gradually from the inner peripheral cam surface 4A of the cam ring 4 as the cam ring 4 moves (swings) in the direction for reducing the amount of eccentricity relative to the rotor 2.

On the front view shown in FIG. 2, the port inner wall surface 15C is formed as a curved surface bent into an arc shape that is substantially identical to the shape of the inner peripheral cam surface 4A of the cam ring 4 in the maximum eccentricity position.

The port inner wall surface 15C is formed to extend in a direction parallel to a rotation axis of the rotor without a step relative to the inner peripheral cam surface 4A of the cam ring 4 when the cam ring 4 is in the maximum eccentricity position shown in FIG. 1A.

An opening width of the communication end side intake port end portion 15B, meanwhile, is formed to be substantially constant from the midpoint of the intake port 15 to the vicinity of a tip end of the communication end side intake port end portion 15B.

A port inner wall surface 15D that extends around the inner peripheral cam surface 4A of the cam ring 4 when the cam ring 4 moves to a position in which the amount of eccentricity relative to the rotor 2 is at the minimum is formed in the communication end side intake port end portion 15B. The port inner wall surface 15D and the inner peripheral cam surface 4A of the cam ring define a flow passage through which the working fluid flows rectilinearly when the cam ring is in the minimum eccentricity position.

The port inner wall surface 15D is formed as a curved surface bent into an arc shape that is substantially identical to the shape of the inner peripheral cam surface 4A of the cam ring 4 in the minimum eccentricity position.

As described above, an outer peripheral side inner wall surface of the intake port 15 is constituted by the port inner wall surface 15C that extends around the inner peripheral cam surface 4A in the maximum eccentricity position, and the port inner wall surface 15D that extends around the inner peripheral cam surface 4A in the minimum eccentricity position.

An inner peripheral side inner peripheral surface 15E of the intake port 15 is formed as a curved surface bent into an arc shape that extends around an outer peripheral portion of the rotor 2.

Next, referring to FIGS. 3A to 4B, actions and effects of the vane pump 100 according to this embodiment will be described while providing comparisons with a conventional vane pump 200.

As shown by a dot-dot-dash line in FIG. 2, an intake port 215 of the conventional vane pump 200 is formed such that an opening width thereof is substantially constant from a circumferential direction midpoint of the intake port 215 to the vicinity of a tip end of a communication start side intake port end portion.

Figure 4A:
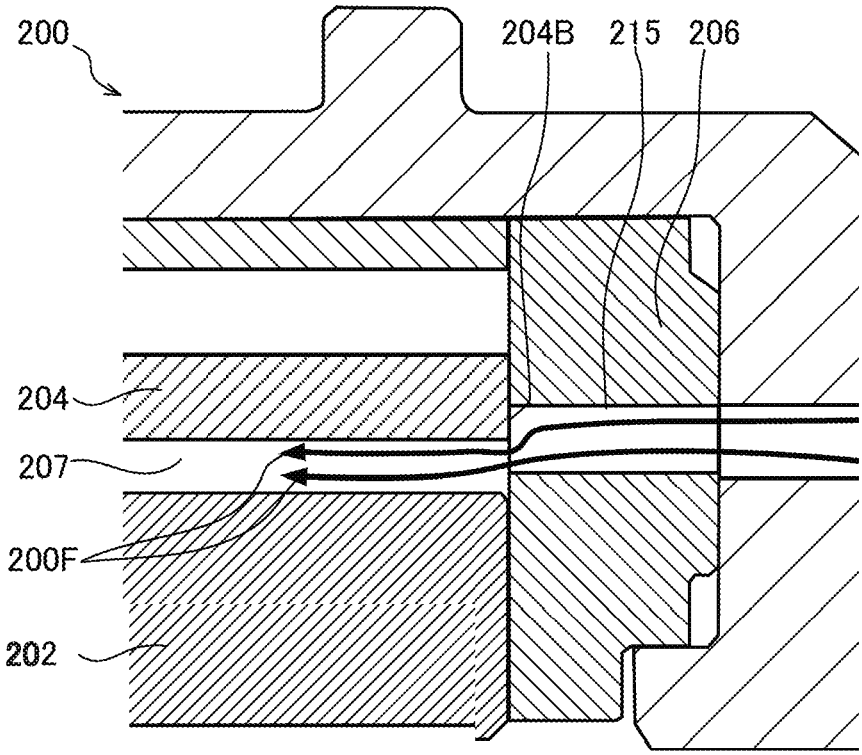
FIG.4A PRIOR ART
FIG. 4A is a sectional view of a conventional variable capacity vane pump.
Figure 4B:
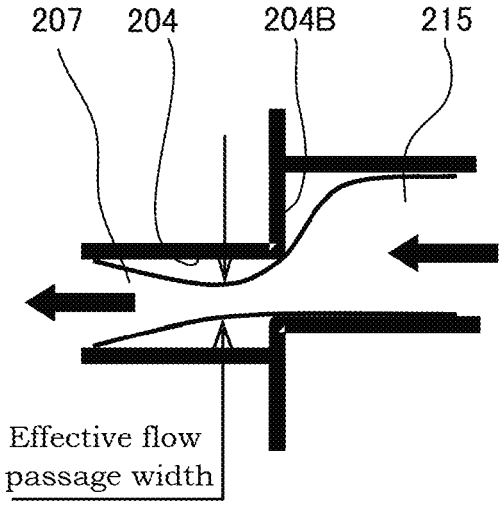
FIG.4B PRIOR ART
FIG. 4B is a pattern diagram showing a flow of working oil through the conventional variable capacity vane pump.

FIG. 4A is a sectional view of the conventional vane pump 200, and FIG. 4B is a pattern diagram illustrating a flow of working oil through the intake port 215.

In the conventional vane pump 200, as shown in FIGS. 4A and 4B, when a cam ring 204 is in a position where an amount of eccentricity relative to a rotor 202 increases, a step 204B is formed by the intake port 215 formed in a side plate 206 and a pump chamber 207. As a result of the step 204B, a part of the intake port 215 is blocked by the cam ring 204 such that working oil suctioned into the pump chamber 207 impinges on the step 204B, leading to a large curve in a flow line 200F of the working oil. Accordingly, an apparent flow passage width (referred to hereafter as an "effective flow passage width") of a flow passage formed between the intake port 215 and the cam ring 204 decreases. Hence, pressure loss exerted on the flow of the working oil increases, and as a result, cavitation may occur between the intake port 215 and the pump chamber 207.

Figure 3A:
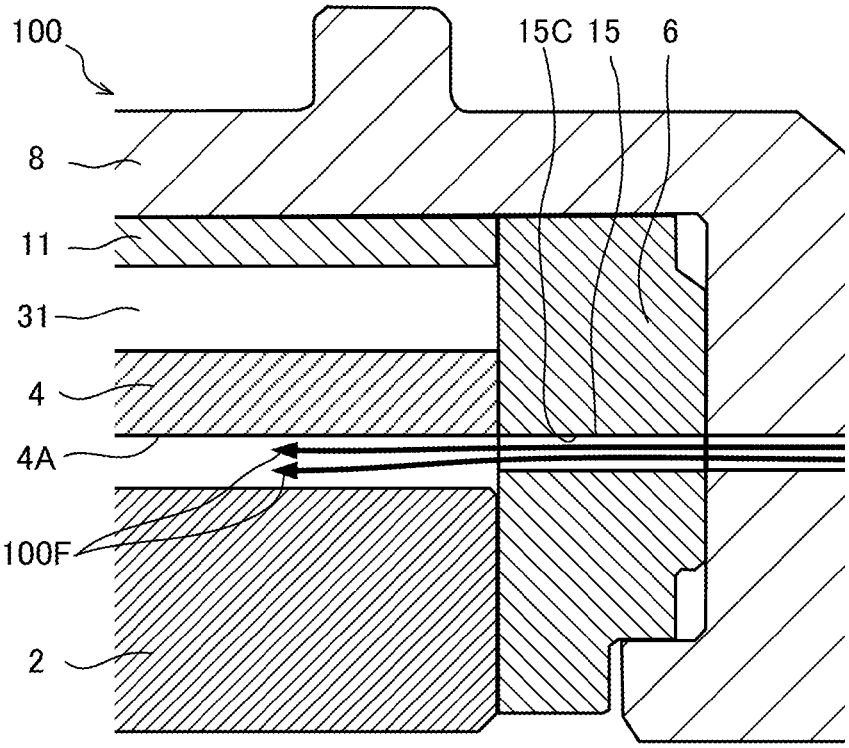
FIG. 3A is a sectional view of the variable capacity vane pump.
Figure 3B:
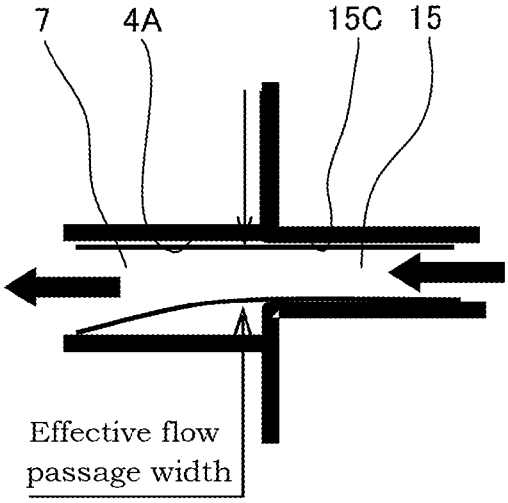
FIG. 3B is a pattern diagram showing a flow of working oil through the variable capacity vane pump.

FIG. 3A is a sectional view of the vane pump 100 according to this embodiment, and FIG. 3B is a pattern diagram illustrating a flow of working oil through the intake port 15.

In the vane pump 100 according to this embodiment, as shown in FIGS. 3A and 3B, when the cam ring 4 is in a position where the amount of eccentricity relative to the rotor 2 increases, the port inner wall surface 15C of the intake port 15 formed in the side plate 6 extends without a step relative to the inner peripheral cam surface 4A of the cam ring 4. Hence, the working oil suctioned into the pump chamber 7 flows directly around the port inner wall surface 15C and the inner peripheral cam surface 4A such that a flow line 100F thereof extends rectilinearly. Accordingly, the effective flow passage width of the flow passage formed between the intake port 15 and the cam ring 4 does not decrease, and therefore pressure loss exerted on the flow of the working oil can be suppressed. As a result, cavitation between the intake port 15 and the pump chamber 7 can be prevented.

When the vane pump 100 is in the operating condition shown in FIGS. 3A and 3B in the rotation speed region of the characteristic diagram shown in FIG. 5 where the discharge flow Q gradually increases as the rotation speed N of the rotor 2 increases, the pressure loss generated in the working oil flowing to the pump chamber 7 is suppressed. Likewise in the rotation speed region exceeding this rotation speed region, where the cam ring 4 swings in the direction for reducing the amount of eccentricity, an opening area of the intake port 15 does not vary, and therefore a step is not formed between the cam ring 4 and the intake port 15 in the flow passage of the working oil flowing to the pump chamber 7. As a result, the pressure loss generated in the working oil flowing to the pump chamber 7 is suppressed.

According to the embodiment described above, following actions and effects are obtained.

(1) The port inner wall surface 15C is formed in the intake port 15 so as to extend around the inner peripheral cam surface 4A of the cam ring 4 when the cam ring 4 moves in the direction for increasing the amount of eccentricity of the cam ring 4 relative to the rotor 2. Hence, pressure loss generated when working fluid suctioned into the pump chamber 7 through the intake port 15 impinges on a step in the cam ring 4 can be suppressed, and as a result, cavitation can be prevented from occurring between the intake port 15 and the pump chamber 7.

(2) The intake port 15 is formed such that the port inner wall surface 15C extends without a step relative to the inner peripheral cam surface 4A of the cam ring 4 when the cam ring 4 moves to the maximum eccentricity position. Hence, the working fluid suctioned into the pump chamber 7 flows directly around the port inner wall surface 15C and the inner peripheral cam surface 4A such that pressure loss exerted on the flow of the working fluid is suppressed.

(3) The intake port 15 includes the communication start side intake port end portion 15A at which communication with the pump chamber 7 starts as the rotor 2 rotates, and the communication end side intake port end portion 15B at which communication with the pump chamber 7 ends as the rotor 2 rotates. Further, the port inner wall surface 15C is formed in the communication start side intake port end portion 15A, and the opening width of the intake port 15 is formed to decrease gradually from the midpoint of the intake port 15 toward the tip end of the communication start side intake port end portion 15A. Hence, the opening area of the intake port 15 does not vary even when the cam ring 4 moves in the direction for reducing the amount of eccentricity, and as a result, a step can be prevented from forming between the cam ring 4 and the intake port 15 in the flow passage through which the working fluid is suctioned into the pump chamber 7.

An embodiment of the present invention was described above, but the above embodiment is merely examples of applications of the present invention, and the technical scope of the present invention is not limited to the specific constitutions of the above embodiment.

The application claims priority based on Japanese Patent Application No. 2012-062309, filed with the Japan Patent Office on Mar. 19, 2012, the entire contents of which are incorporated herein by reference.

INDUSTRIAL APPLICABILITY

The variable capacity vane pump according to the present invention can be used in a fluid pressure device such as a power steering apparatus or a continuously variable transmission, for example.

The invention claimed is:

1. A variable capacity vane pump comprising:

a rotor configured to be driven to rotate;

a plurality of vanes housed in the rotor to be free to slide;

a cam ring comprising an inner peripheral cam surface against which respective tip end portions of the vanes are slidable, said cam ring being configured to rotate eccentrically relative to a center of the rotor;

a pump chamber defined by the rotor and the cam ring in between adjacent vanes;

an intake port having an arc shape around the center of the rotor and being configured to lead working fluid into the pump chamber, said intake port comprising:

a first port inner wall surface having a shape that corresponds to a shape of the inner peripheral cam surface of the cam ring in a maximum eccentricity position; and a second port inner wall surface having a shape that corresponds to a shape of the inner peripheral cam surface of the cam ring in a minimum eccentricity position; and a discharge port configured to lead the working fluid from the pump chamber, wherein the intake port comprises:

a communication start side intake port end portion at which communication with the pump chamber starts as the rotor rotates; and a communication end side intake port end portion at which communication with the pump chamber ends as the rotor rotates, the first port inner wall surface is in the communication start side intake port end portion, and the second port inner wall surface is in the communication end side intake port end portion.

2. The variable capacity vane pump as defined in claim 1, wherein, when the cam ring is in the maximum eccentricity position, the first port inner wall surface extends in a direction parallel to a rotation axis of the rotor without a step relative to the inner peripheral cam surface of the cam ring.

3. The variable capacity vane pump as defined in claim 2, further comprising:

a side plate configured to contact a side portion of the rotor and a side portion of the cam ring when the side plate is housed in the pump chamber.

4. The variable capacity vane pump as defined in claim 1, wherein an opening width of the intake port is configured to decrease gradually from a midpoint of the intake port toward a tip end of the communication start side intake port end portion.

5. The variable capacity vane pump as defined in claim 1, further comprising:

an adapter ring surrounds the cam ring; and a support pin interposed between the adapter ring and the cam ring, wherein the cam ring is configured to swing, with the support pin as a fulcrum, inside the adapter ring and eccentrically relative to the center of the rotor.

6. The variable capacity vane pump as defined in claim 5, wherein the adapter ring comprises:

a first limitation configured to limit movement of the cam ring in a direction for reducing an amount of eccentricity relative to the center of the rotor; and a second limitation configured to limit movement of the cam ring in a direction for increasing the amount of eccentricity relative to the center of the rotor.

7. The variable capacity vane pump as defined in claim 1, wherein the first port inner wall surface and the inner peripheral cam surface of the cam ring define a flow passage through which the working fluid flows rectilinearly when the cam ring is in the maximum eccentricity position, and the second port inner wall surface and the inner peripheral cam surface of the cam ring define a flow passage through which the working fluid flows rectilinearly when the cam ring is in the minimum eccentricity position.

* * * * *